US008038378B2

(12) United States Patent
Aoki et al.

(10) Patent No.: US 8,038,378 B2
(45) Date of Patent: Oct. 18, 2011

(54) TAPE TYPE BINDING APPARATUS AND PAPER STAPLE

(75) Inventors: Akira Aoki, Tokyo (JP); Hiroshi Udagawa, Tokyo (JP); Shinichi Takeuchi, Tokyo (JP)

(73) Assignee: Max Co., Ltd., Tokyo (JP)

( * ) Notice: Subject to any disclaimer, the term of this patent is extended or adjusted under 35 U.S.C. 154(b) by 659 days.

(21) Appl. No.: 12/089,953

(22) PCT Filed: Dec. 15, 2006

(86) PCT No.: PCT/JP2006/325576

§ 371 (c)(1),
(2), (4) Date: Apr. 11, 2008

(87) PCT Pub. No.: WO2007/072939

PCT Pub. Date: Jun. 28, 2007

(65) Prior Publication Data

US 2009/0136324 A1 May 28, 2009

(30) Foreign Application Priority Data

Dec. 19, 2005 (JP) ..... 2005-365617

(51) Int. Cl.
*B42B 5/04* (2006.01)
*B42B 5/00* (2006.01)
*B42B 5/06* (2006.01)

(52) U.S. Cl. ..... 412/36; 412/33; 412/34

(58) Field of Classification Search ..... 412/33, 412/34, 36, 38, 43; 227/76; *B42B 5/00*
See application file for complete search history.

(56) References Cited

U.S. PATENT DOCUMENTS

| | | | | |
|---|---|---|---|---|
| 4,431,127 | A * | 2/1984 | Watanabe | 227/76 |
| 5,697,747 | A * | 12/1997 | Sawada et al. | 412/36 |
| 7,021,512 | B1 * | 4/2006 | Nakamura | 227/76 |

FOREIGN PATENT DOCUMENTS

| | | | |
|---|---|---|---|
| EP | 0 695 648 | | 2/1996 |
| JP | 58101096 | * | 6/1983 |
| JP | 08-39959 | | 2/1996 |
| JP | 10-871 | | 1/1998 |
| JP | 11-207654 | | 8/1999 |
| JP | 11347966 | * | 12/1999 |
| WO | 2005/072978 | | 8/2005 |
| WO | WO2005072978 | * | 8/2005 |

OTHER PUBLICATIONS

JP11347966 DERWENT Abstract.*

* cited by examiner

*Primary Examiner* — Dana Ross
*Assistant Examiner* — Kyle Grabowski
(74) *Attorney, Agent, or Firm* — Drinker Biddle & Reath LLP

(57) ABSTRACT

A tape type binding apparatus includes a cutter portion formed in a U-shape inside which a paper staple is held, a paper table formed with a drawing hole through which cutter blades of the cutter portion can be inserted, a pair of pressing members arranged on respective sides of the drawing hole, and a pressing piece arranged below the center of the drawing hole. The cutter blades and leg portions of the paper staple penetrate a stack of sheets placed on the paper table by moving down the cutter portion, the pair of pressing members folds the leg portions of the paper staple to inner sides by moving toward the center of the drawing hole through rectangular holes formed on respective cutter blades, and the pressing piece presses and bonds the folded leg portions by relatively moving up with respect to the paper table.

8 Claims, 19 Drawing Sheets

TAPE TYPE BINDING APPARATUS AND PAPER STAPLE

TECHNICAL FIELD

The present invention relates to a tape type binding apparatus and a paper staple, in which the tape type binding apparatus binds a stack of papers such as documents with a paper made adhesive tape.

BACKGROUND ART

Conventionally, a stapler is used when simply binding a stack of papers. However, when recycling the papers bound with staples made of metal lines, the mixed staples needs to be removed. Also when disposing such a stack of stapled papers, it is preferable to separate the staples from the papers in view of environmental protection. Nevertheless, extra time and labor is required for such a separating work.

As a proposal for dispensing with such time and labor, there a binding apparatus which binds a stack of papers by a paper made adhesive tape in stead of a metal staple (see, e.g., JP-A-8-039959 and JP-A-10-000871). The binding apparatus uses a paper made adhesive tape roll, and includes a slider having a clamp plate for clamping papers and a lift type cutter portion above a paper table which is similar to a general desktop stapler.

The paper made adhesive tape roll includes a predetermined length (a length used in a single binding operation) of paper made adhesive tapes and a release tape on which the paper made adhesive tapes are continuously stuck. A front end portion of the adhesive tape is set such that it is erected from a lower side of the paper table to an upper side, and such that an adhering face thereof is opposed to an end face of the stack of sheets of paper placed on the paper table.

When an edge portion of the stack of papers is held by the clamp plate of the slider, and then the slider and the stack of papers are slid toward a front side, the end face of the stack of papers is comes into contact with the adhering face of the adhesive tape.

Next, when the cutter portion is moved down, a pressing member integral with the cutter portion presses a front end portion of the adhesive tape to an upper face of the edge portion of the stack of papers, and a blade of the cutter portion penetrates through a vicinity of the edge portion of the stack of papers from the upper side to the lower side.

Further, by pressing the adhesive tape with a front end of the blade, a rear portion of the adhesive tape for the first single binding is released from the release paper. A rectangular hole is formed near the front end of the blade, and the released rear portion end of the adhesive tape moves into the rectangular hole by an elastic recovery force. Accordingly, the released rear end of the adhesive tape is brought into a state of penetrating the blade in a front and rear direction.

Subsequently, when the cutter portion is released from being pressed manually, the cutter portion moves up by a spring, thereby pulling up the rear portion of the adhesive tape caught by the blade through a cut hole of the stack of papers and to an upper face side of the stack of papers along with the blade. When the blade moves up further, the rear portion of the adhesive tape is drawn from the rectangular hole of the blade, and the rear portion of the adhesive tape is erected.

Finally, when the slider and the stack of papers are moved back, the rear portion of the adhesive tape is squeezed by a roller arranged above the paper table, and the rear portion of the adhesive tape is adhered on top of the front end portion of the adhesive tape which has already been stuck to the stack of papers, thereby finishing the binding process.

However, according to such binding apparatuses using the paper made adhesive tape, one binding process is carried out by holding and sliding the papers with the clamp plate of the slider toward the front side, moving down the cutter portion, and thereafter, sliding the slider and the papers to a rear side. Accordingly, a number of operating steps is required, and therefore, improvements should be made in terms of operability and swiftness.

Further, one side of the adhesive tape is provided with an adhesive layer on an entire face thereof so that the adhesive tape is stuck on a surface of the papers. Therefore, there is another problem in that, when unbinding the stack of stapled papers, it is difficult to release the adhesive tape without damaging the papers.

DISCLOSURE OF THE INVENTION

One or more embodiments of the invention provides a tape type binding apparatus and a paper staple in which a binding process is simplified and a stack of stapled papers can be easily unbound.

According to one or more embodiments of the invention, a tape type binding apparatus for binding a stack of sheets with a paper staple that is bent in a U-shape having an adhesive agent layer on an inner face thereof, the tape type binding apparatus includes: a cutter portion formed in a U-shape inside which the paper staple is held, the cutter portion including a pair of cutter blades, each formed with a rectangular hole; a paper table formed with a drawing hole through which the pair of cutter blades can be inserted; a pair of pressing members arranged on respective sides of the drawing hole, each pressing member being able to move toward a center of the drawing hole; and a pressing piece arranged below the center of the drawing hole. The pair of cutter blades and leg portions of the paper staple penetrate the stack of sheets placed on the paper table by moving down the cutter portion which holds the paper staple thereinside, the pair of pressing members folds the leg portions of the paper staple to inner sides by moving toward the center of the drawing hole through the respective rectangular holes, and the pressing piece presses and bonds the folded leg portions by relatively moving up with respect to the paper table.

According to one or more embodiments of the invention, a paper staple which is adapted to be used in the above described tape type binding apparatus, the paper staple includes: a paper tape that is bent in a U-shape; and an adhesive agent layer. The paper tape includes a pair of leg portions, and the adhesive layer is provided at a lower portion of an inner face of one of the leg portions.

BEST MODE FOR CARRYING OUT THE INVENTION

Figure 1:
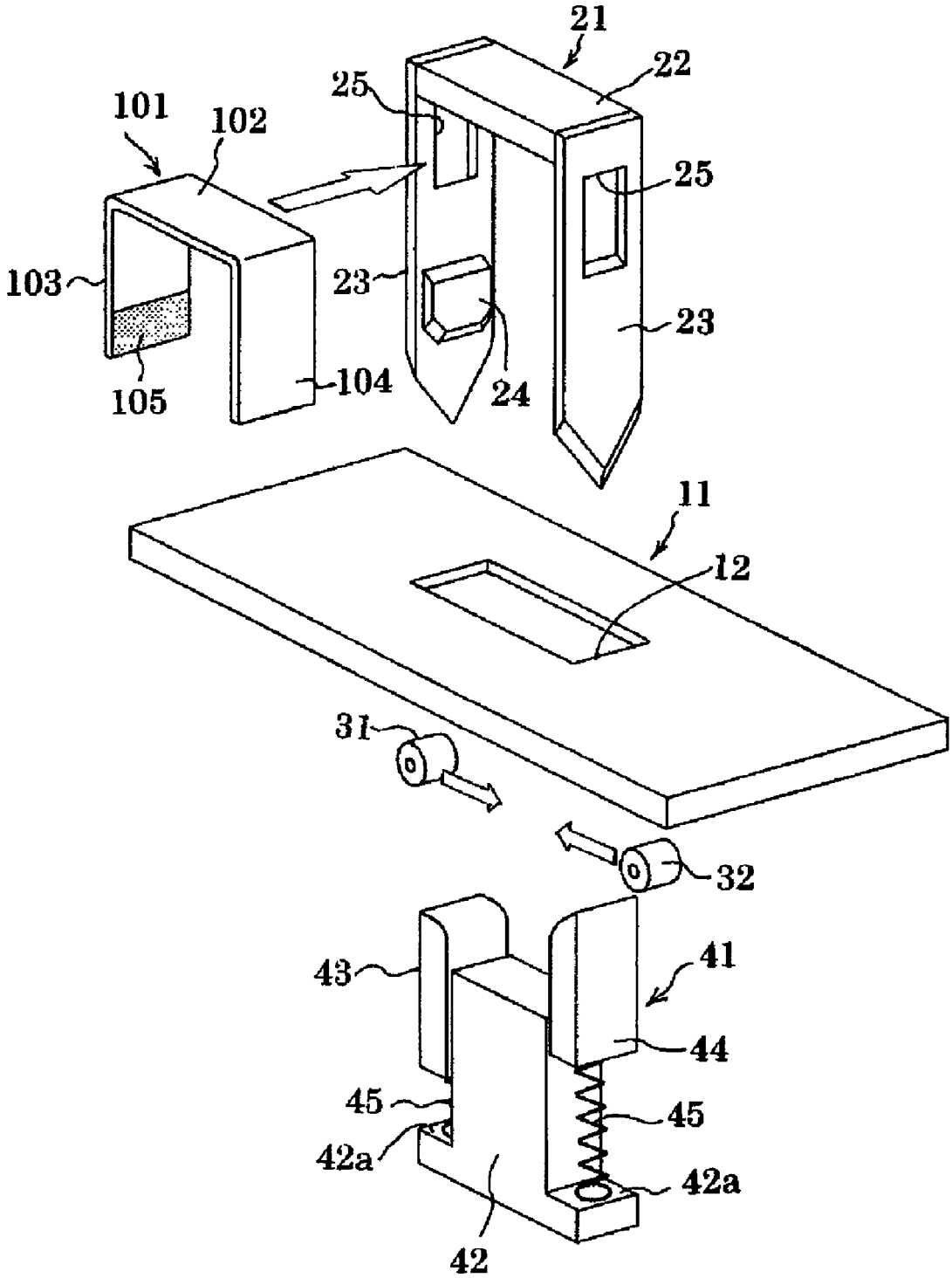
FIG. 1 is an explanatory view of a binding mechanism of a tape type binding apparatus according to a first embodiment.

Hereinafter, embodiments of the invention will be explained with reference to the drawings, the following exemplary embodiments do not limit the scope of the invention. According to the embodiments, a tape type binding apparatus for binding a stack of sheets with a paper staple that is bent in a U-shape having an adhesive agent layer on an inner face thereof, the tape type binding apparatus includes: a cutter portion formed in a U-shape inside which the paper staple is held, the cutter portion including a pair of cutter blades, each formed with a rectangular hole; a paper table formed with a drawing hole through which the pair of cutter blades can be inserted; a pair of pressing members arranged on respective sides of the drawing hole, each pressing member being able to move toward a center of the drawing hole; and a pressing piece arranged below the center of the drawing hole.

According to such a configuration, a binding operation is carried out such that the pair of cutter blades and leg portions of the paper staple penetrate the stack of sheets placed on the paper table by moving down the cutter portion which holds the paper staple thereinside, the pair of pressing members folds the leg portions of the paper staple to inner sides by moving toward the center of the drawing hole through the respective rectangular holes, and the pressing piece presses and bonds the folded leg portions by relatively moving up with respect to the paper table.

Therefore, the binding operation is simple, swiftness of the binding process is enhanced, and the paper tape can be simply removed from the stack of bound sheets.

Embodiment 1

FIG. 1 shows a binding mechanism of a tape type binding apparatus. Reference numeral 101 designates a paper made binding member that is previously bent in a U-shape, and in the following description, the paper made binding member is referred to as a paper staple. The paper staple 101 includes a horizontal crown portion 102, a pair of leg portions 103, 104 which extend to a lower side from both left and right ends of the horizontal crown portion 102. Only one of the leg portions (the leg portion 103 on the left side in the drawing) is coated with an adhesive agent 105 at an inner face thereof, and the left and right leg portions 103, 104 are adhered by folding the right leg portion 104 to an inner side, and thereafter, folding the left leg portion 103 to the inner side.

Reference numeral 11 designates a paper table for receiving papers, and a cutter portion 21 is disposed above the paper table 11. The cutter portion 21 is a U-shape member in which cutter blades 23 are attached to both ends of a horizontal bar 22. A lower end tip of the cutter blade 23 is formed in a V-shape.

An interval of inner faces of the left and right cutter blades 23 is substantially equal to a transverse width of the paper staple 101, and a width in a front and rear direction of the cutter blade 23 is substantially equal to that of the paper staple 101, so that the paper staple 101 can be fitted to an inner side of the cutter portion 21.

On lower portions of inner faces of the left and right cutter blades 23, a pair of protrusions 24 is disposed so as to face each other. The protrusions 24 have a height that is higher than a thickness of the paper staple. An interval between an upper end of the protrusion 24 and a lower face of the bar 22 is slightly longer than a height of the paper staple 101 so that the leg portions 103, 104 of the paper staple 101 are respectively supported by upper end faces of the protrusions 24. In addition, the protrusions 24 prevent the leg portions 103, 104 of the paper staple 101 from being buckled when the cutter blades 23 cut and penetrate the papers. In another implementation, the paper staple 101 may be held at the inner faces of the left and right cutter blades 23 by utilizing a spring force of the paper staple 101, in which the spring force tries to move the leg portions 103, 104 away from each other. The upper end face and the lower end face of the protrusion 24 are formed as inclined faces of a trapezoidal shape so as to achieve smoothness when the cutter blade 23 penetrates the papers and when drawing the cutter blade 23 from the papers. Further, rectangular holes 25 are formed on the left and right cutter blades 23 above the protrusions 24. When the cutter portion 21 moves down, rollers 31, 32 as a pair of pressing members arranged below the paper table 11 move into the inner side of the cutter portion 21 from the rectangular holes 25.

A center of the paper table 11 is formed with a rectangular drawing hole 12 through which the cutter portion 21 is penetrated from an upper side. The pair of rollers 31, 32 below the paper table 11 are disposed on both left and right sides of the drawing hole 12. Although not illustrated in the drawings, the pair of rollers 31, 32 is respectively attached to a pair of shafts in a rotatable state. The pair of shafts 31, 32 moves symmetrically so as to become close to each other and to move away from each other. The pair of rollers 31, 32 move so as to become close to each other interlockingly with an operation of moving down the cutter portion 21.

Right below the drawing hole 12, a clincher portion 41 is arranged. The clincher portion 41 folds and presses the leg portions 103, 104 of the paper staple 101 so as to bond them. The clincher portion 41 includes a pressing piece 42 at the center thereof and clinchers 43, 44 arranged on left and right sides of the pressing piece 42. The left clincher 43 and the right clincher 44 are respectively biased upward by compression springs 45, and are slidable in a vertical direction. Each compression springs 45 is interposed between the respective clinchers 43 or 44 and a spring receiving portion 42*a* formed on a lower portion of the pressing piece 42. The clinchers 43, 44 fold the leg portions 103, 104 of the paper staple 101 when the pressing piece 42 moves upward, and then, the pressing piece 42 presses and bonds the folded leg portions 103, 104.

The clincher portion 41 moves up from a state shown in FIG. 1, and folds the left and right leg portions 103, 104 of the paper staple 101 so as to press and bond them. Heights of upper ends of the clinchers 43, 44 are different. More specifically, the height of the left clincher 43 is lower than that of the right clincher 44. Therefore, when the clincher portion 41 moves up, the right clincher 44 comes into contact with the right leg portion 104 of the paper staple 101 in advance, and thereafter, the left clincher 43 comes into contact with the left leg portion 103 of the paper staple 101. Namely, timings of folding the left and right leg portions 103, 104 of the paper staple 101 is shifted so that the left leg portion 103 on which the adhesive agent 105 is attached is folded after folding the right leg portion 104, thereby pressing and bonding the left leg portion 103 to a surface of the right leg portion 104.

Figure 2A:
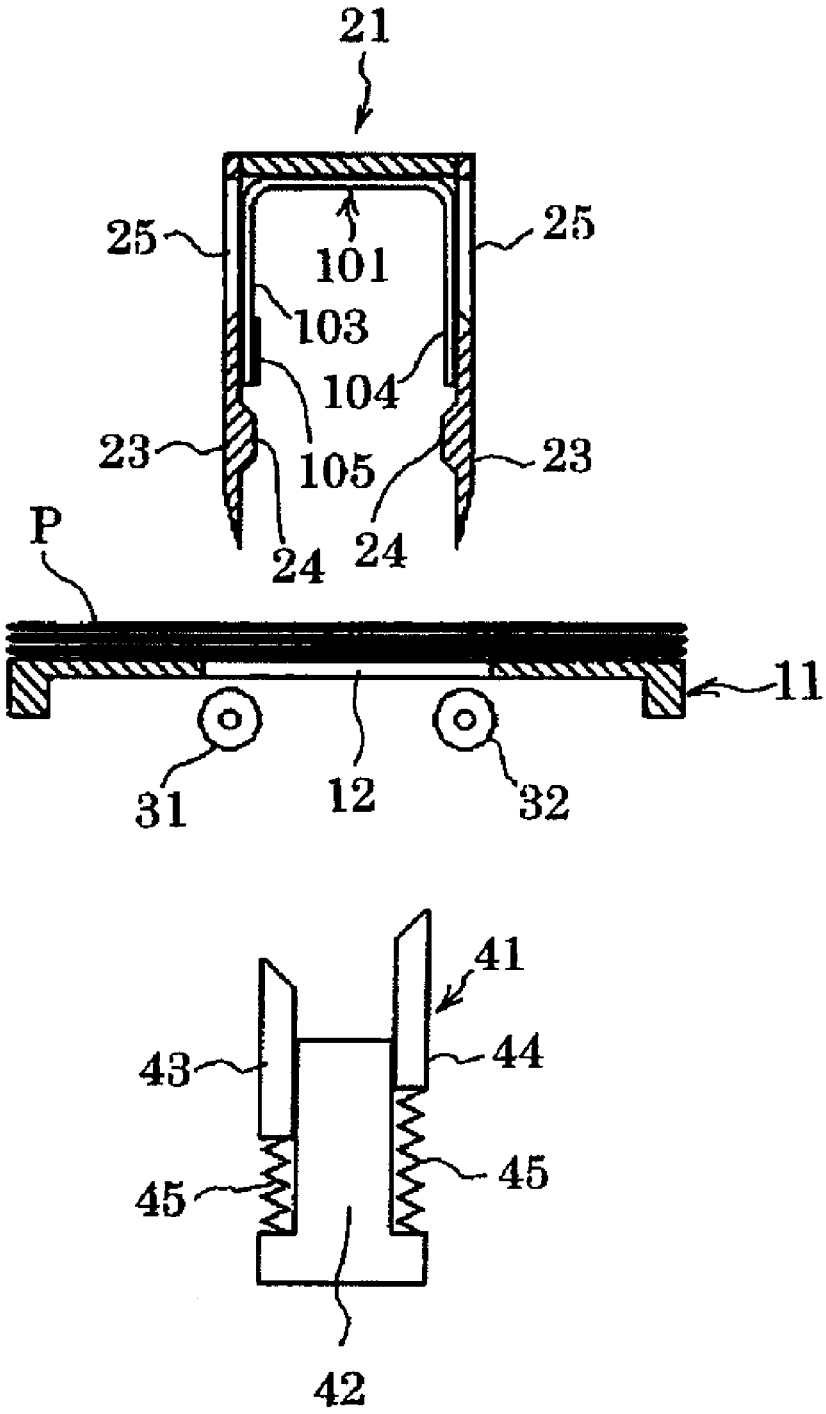
FIG. 2A to FIG. 2F are explanatory views showing a binding process according to the first embodiment.

Next, an operation of a binding mechanism of the tape type binding apparatus will be explained. FIG. 2A shows an initial stage of a binding process, in which the paper staple 101 is set on the inner side of the cutter portion 21, and sheets of paper P to be bound are set on the paper table 11.

Figure 2B:
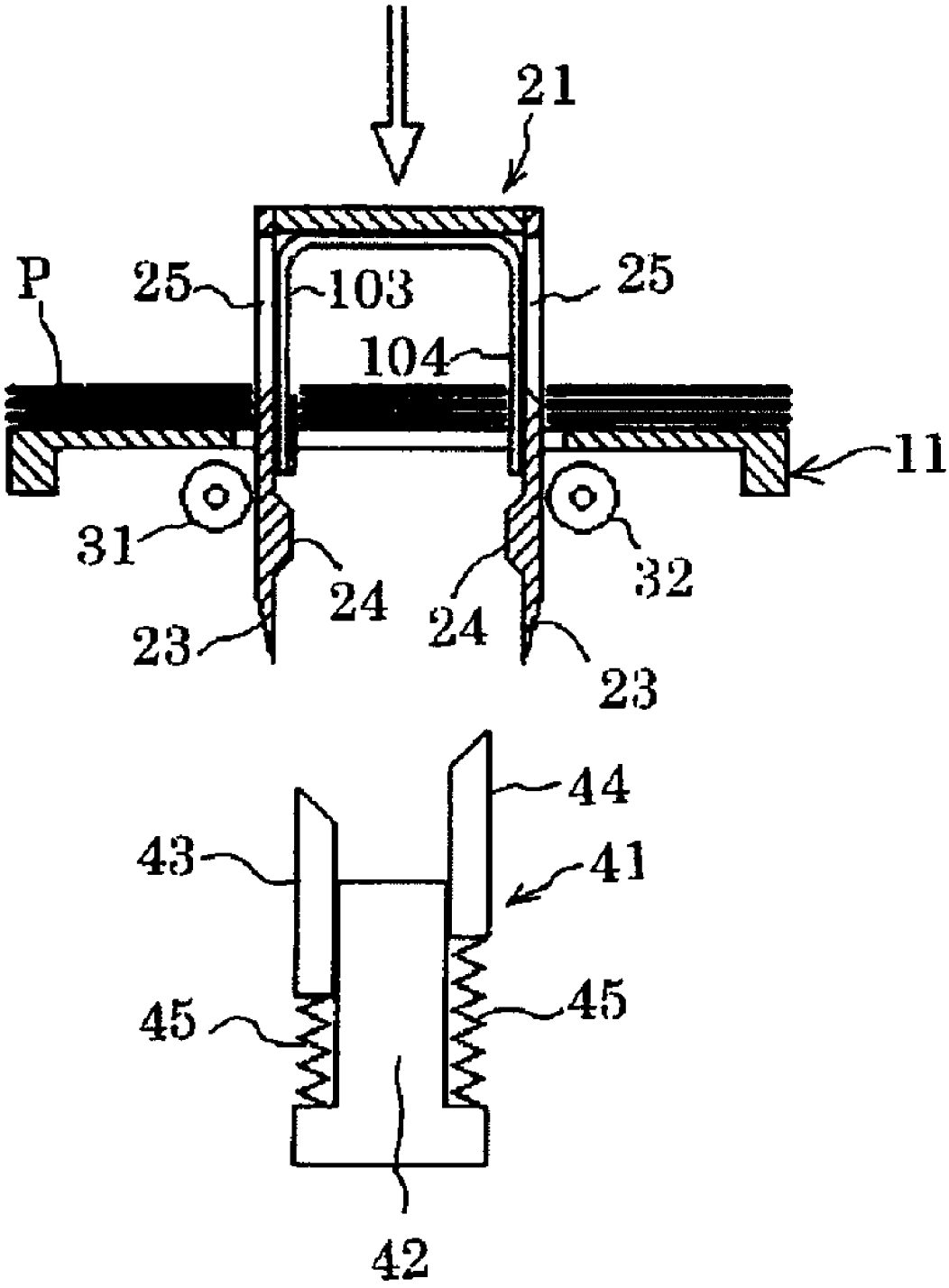

FIG. 2B shows a state in which the cutter portion 21 is moved down, and the cutter blades 23 penetrate the sheets of paper P and projected downward from the drawing hole 12 of the paper table 11. At this time, the pair of rollers 31, 32 is retreated from a path of the cutter blades 23 by widening an interval therebetween. The protrusions 24 provided on the inner faces of the cutter blades 23 widen cut openings of the sheets of paper P. Therefore, the leg portions 103, 104 are prevented from being buckled by sliding resistances between the leg portions 103, 104 and the cut openings when the leg portions 103, 104 of the paper staple 101 pass through the cut openings.

Figure 2C:
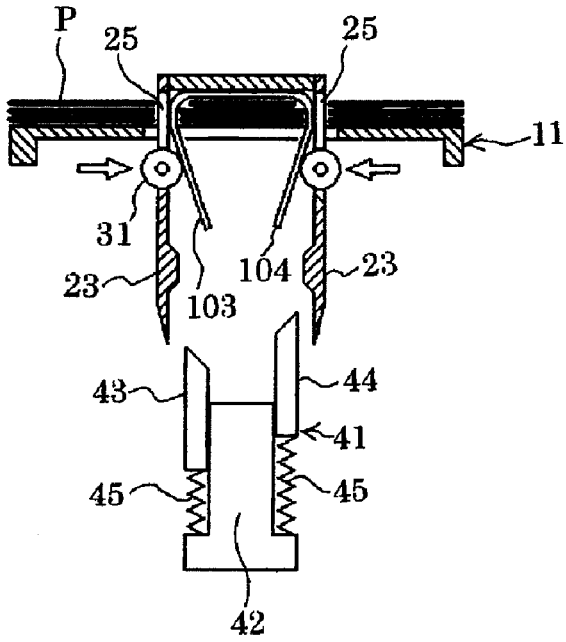

FIG. 2C shows a state in which the cutter portion 21 is moved down to a moving down end. The crown portion 102 of the paper staple 101 is pressed on a surface of a stack of sheets of paper P, and the pair of rollers 31, 32 moves so as to be close to each other. Respective rollers 31, 32 pass through the rectangular holes 25 of the cutter blades 23 and move into to the inner side of the cutter portion 21, thereby slightly folding the left and right leg portions 103, 104 of the paper staple 101.

Figure 2D:
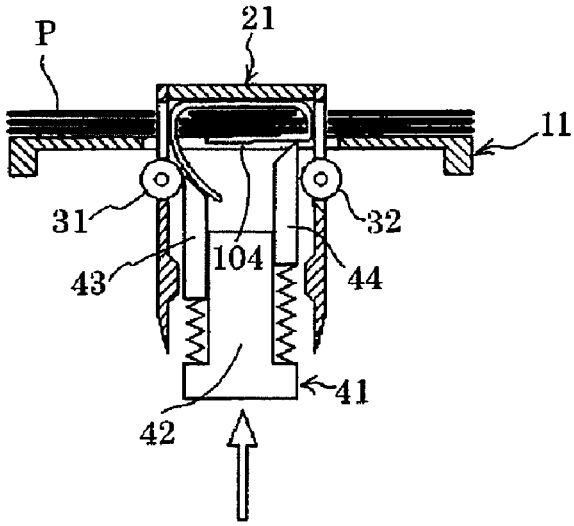

Subsequently, as shown in FIG. 2D, the clincher portion 41 starts to move up, and upper ends of the left and right clinchers 43, 44 move up between the cutter blades 23 and the leg portions 103, 104 of the paper staple 101. The right clincher 44 having the higher height pushes up the right leg portion 104 of the paper staple 101 in advance to fold the right leg portion substantially by 90 degrees, and presses the right leg portion 104 to a back face of the stack of sheets of paper P.

Figure 2E:
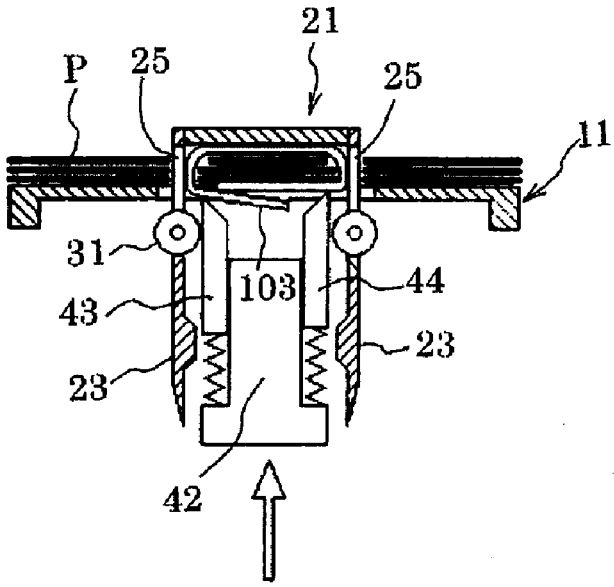

Thereafter, the pressing piece 42 disposed at the center is moved up while compressing the compression spring 45 on the right side. Then, the left clincher 43 pushes up the left leg portion 103 of the paper staple 101 with a delay relative to the right clincher 44, and folds the left leg portion 103 by almost 90 degrees so as to overlap the left leg portion 103 with a surface of the right leg portion 104, as shown in FIG. 2E.

Figure 2F:
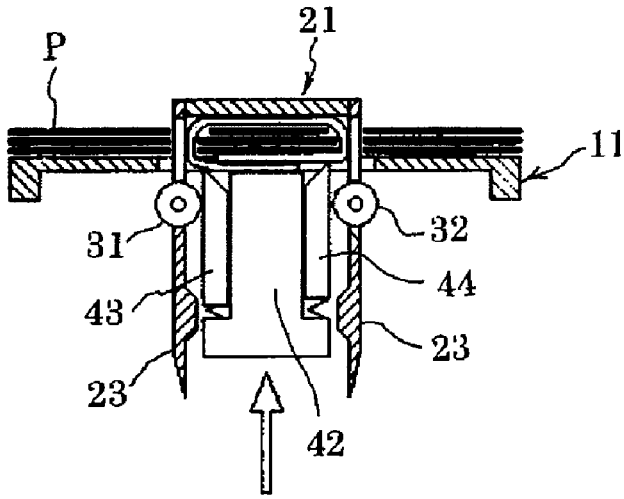

After the left clincher 43 stops moving up at the back face of the paper P interposing the paper staple 101 between the left clincher 43 and the paper P, the pressing piece 42 is further moved up, thereby compressing the overlapped right leg portion 104 and the left leg portion 103 as shown in FIG. 2F. Accordingly, the adhesive layer 105 at the inner face of the left leg portion 103 is stuck to the right leg portion 104, and the paper staple 101 is made to form a flattened loop, thereby binding the stack of the sheets of paper P.

Finally, the clincher portion 41 is moved down, and the left and right rollers 31, 32 are respectively moved to outer sides. On the other hand, the cutter portion 21 is moved up to be drawn out from the cut opening of the stack of sheets of paper P, thereby releasing the sheets of paper P.

The paper staple 101 is adhered by overlapping the end portions of the two leg portions 103, 104 and is not stuck to the sheets of paper P. Therefore, when the stack of bound sheets of paper P needs to be unbound, the sheets of paper P can be simply unbound by tearing the paper staple 101. This is different from the background art in which an adhesive tape is stuck to the sheets of papers, since there is no need to worry about breaking or tearing the sheets of paper P.

Although in the above-described embodiment, an explanation has been given such that the paper table 11 is fixed and the clincher portion 41 is moved up, there may be a configuration in which the clincher portion 41 is fixed and the paper table 11 as well as the rollers 31, 32 can be integrally moved up and down in a certain range. In such a case, when pushing down the cutter portion 21 from a state in which the cutter portion 21 is brought into contact with the upper face of the stack of sheets of paper P as shown in FIG. 2C, the paper table 11 is moved down by being pushed by the cutter portion 21, so that the fixed clincher portion 41 can fold the two leg portions 103, 104 of the paper staple 101 so as to press and bond them in a similar way as shown in FIG. 2D to FIG. 2F.

Further, the pair of rollers 31, 32 may be made to move so as to be close to each other and to move away from each other interlockingly with the up and down movement of the cutter portion 21 by providing a interlocking mechanism such as a cam or a link. With such a configuration, a tape type binding apparatus having better operability can be provided, in which a binding process is performed in one operation by moving down the cutter portion 21.

Embodiment 2

FIG. 3A to FIG. 3F show a second embodiment in which cams 33, 34 are used instead of the rollers 31, 32 as the pair of pressing members for making the two leg portions 103, 104 of the paper staple 101 to become close to each other. Configurations and operations of other portions are the same as those of the first embodiment.

Figure 3A:
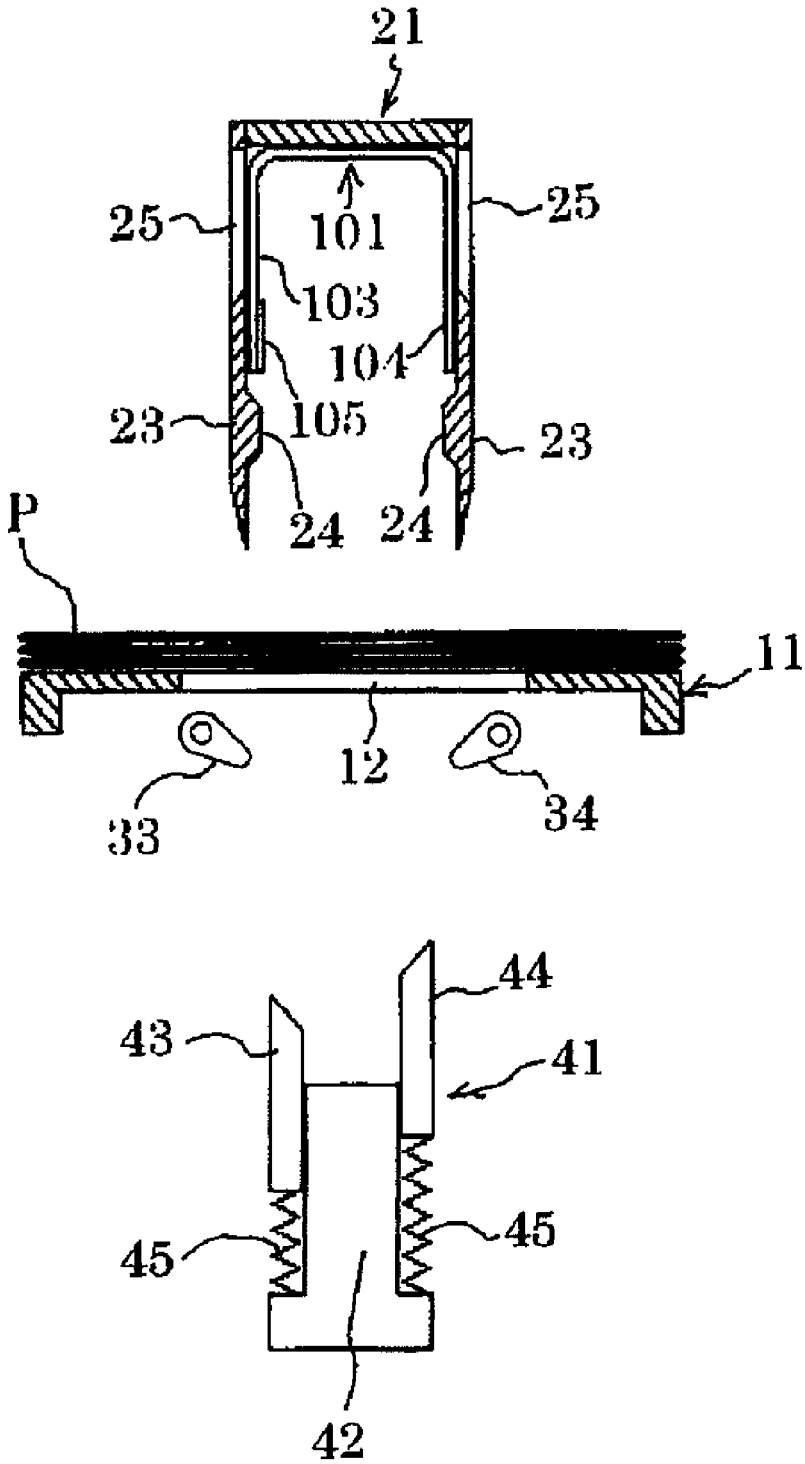
FIG. 3A to FIG. 3F are explanatory views showing a binding process according to a second embodiment.
Figure 3B:
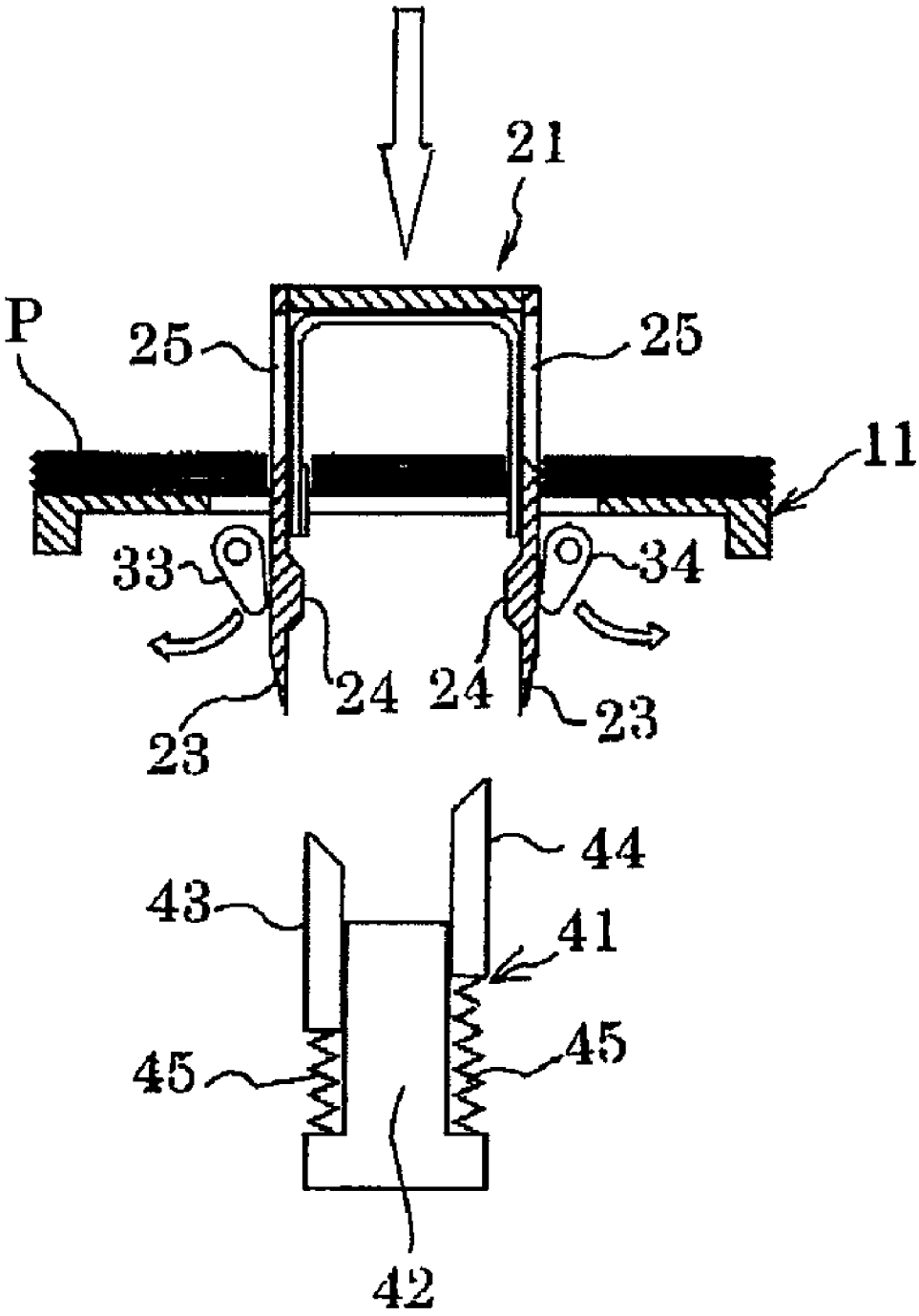

A distance between axes of the pair of left and right cams 33, 34 is set to be wider than a transverse width of the cutter portion 21. When the cutter portion 21 is moved down from an initial state shown in FIG. 3A, the pair of cams 33, 34 are retreated from the vertical moving paths of the cutter blades 23 by rotating in opening directions as shown in FIG. 3B.

Figure 3C:
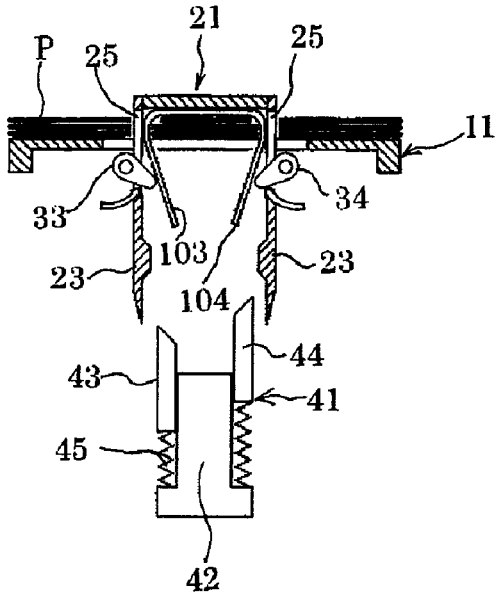

Subsequently, when the cutter portion 21 reaches a moving down end as shown in FIG. 3C, the cams 33, 34 are rotated in directions of becoming close to each other, thereby moving into the inner side of the cutter portion 21 through the rectangular holes 25 of the cutter blades 23 and pushing the two leg portions 103, 104 of the paper staple 101 to the inner side.

Figure 3D:
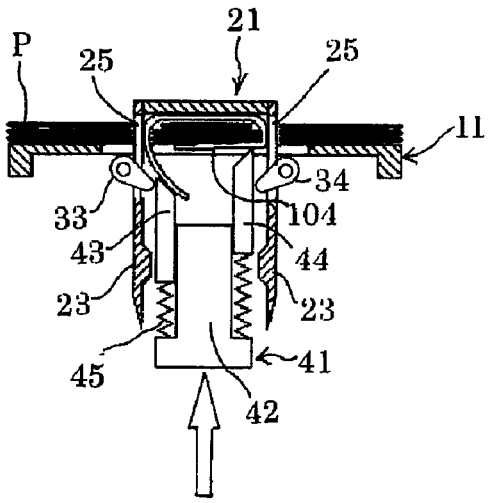
Figure 3E:
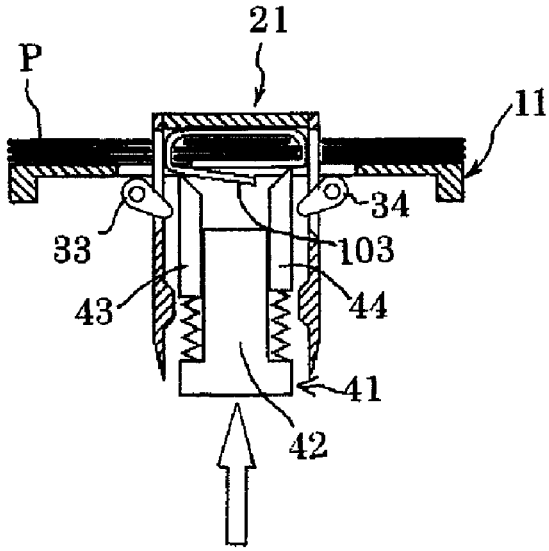
Figure 3F:
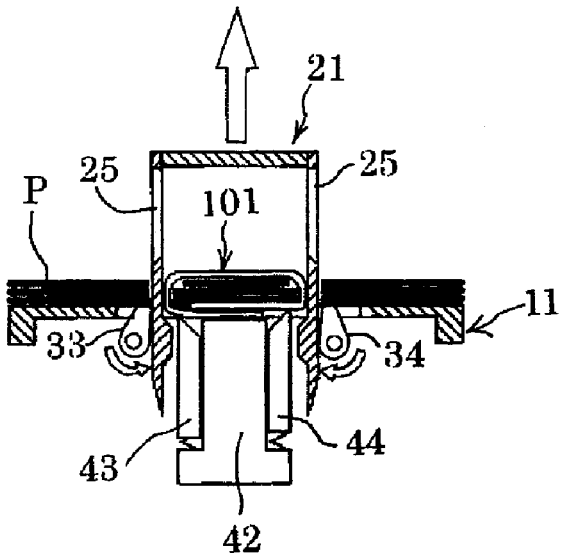

Further, in the steps shown in FIG. 3D to FIG. 3F which is similar to those shown in FIG. 2D to FIG. 2F, the leg portions 103, 104 of the paper staple 101 are folded so as to be pressed and bonded by the clincher portion 41, the pair of left and right cams 33, 34 are retreated from the vertical moving path of the cutter blades 23 by rotating on upper sides or lower sides, the cutter portion 21 is moved up, and the clincher portion 41 is moved down, thereby releasing the sheets of papers P.

Embodiment 3

Although the two leg portions 103, 104 of the paper staple 101 are folded to almost 90 degrees by the pair of clinchers 43, 44 of the clincher portion 41 in the first embodiment and the second embodiment, the clinchers 43, 44 may be omitted by providing a folding function to rollers or cams which move the leg portions of the paper staple proximate to the inner side.

Figure 4:
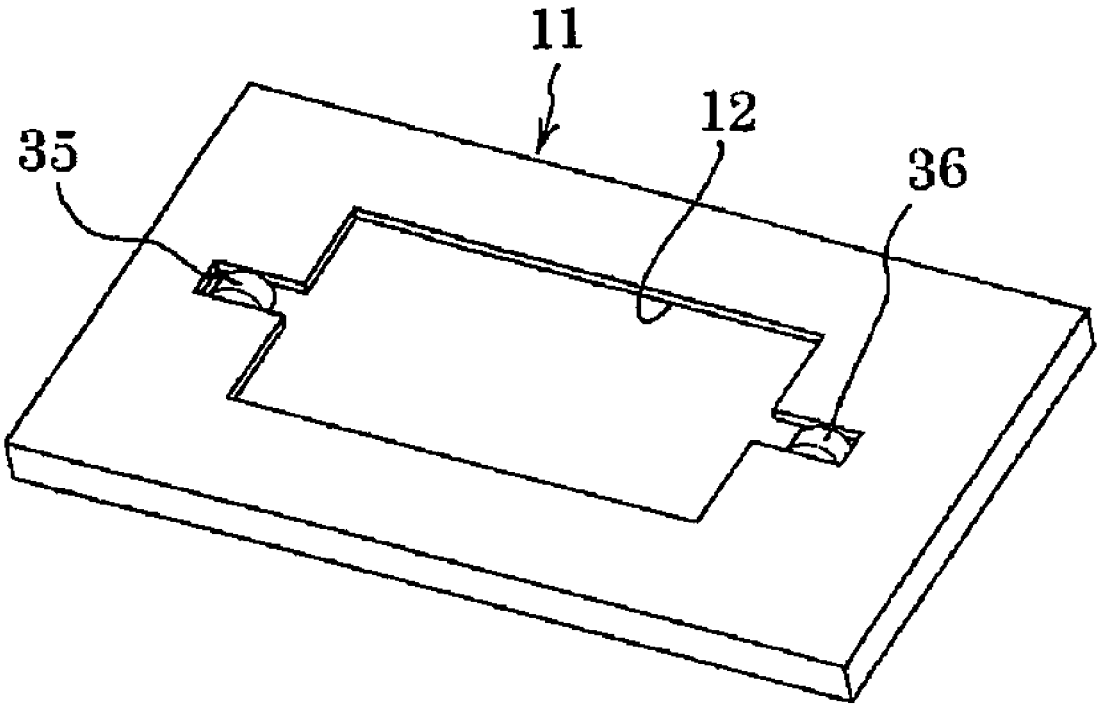
FIG. 4 is a perspective view showing an arrangement of a roller in a binding mechanism of a tape type binding apparatus according to a third embodiment.

According to a third embodiment, a range of expanding and contracting an interval between a pair of left and right rollers is wider than that of the first embodiment. As shown in FIG. 4, upper ends of a pair of left and right rollers 35, 36 are arranged so as to be at a height that is substantially equal to the surface of the paper table 11.

FIG. 5A to FIG. 5E show steps of a binding operation. The pressing piece 42 is arranged below the paper table 11. In other words, the clincher portion 41 according to the first or second embodiments is arranged, but without the left and right clinchers 43, 44.

Figure 5A:
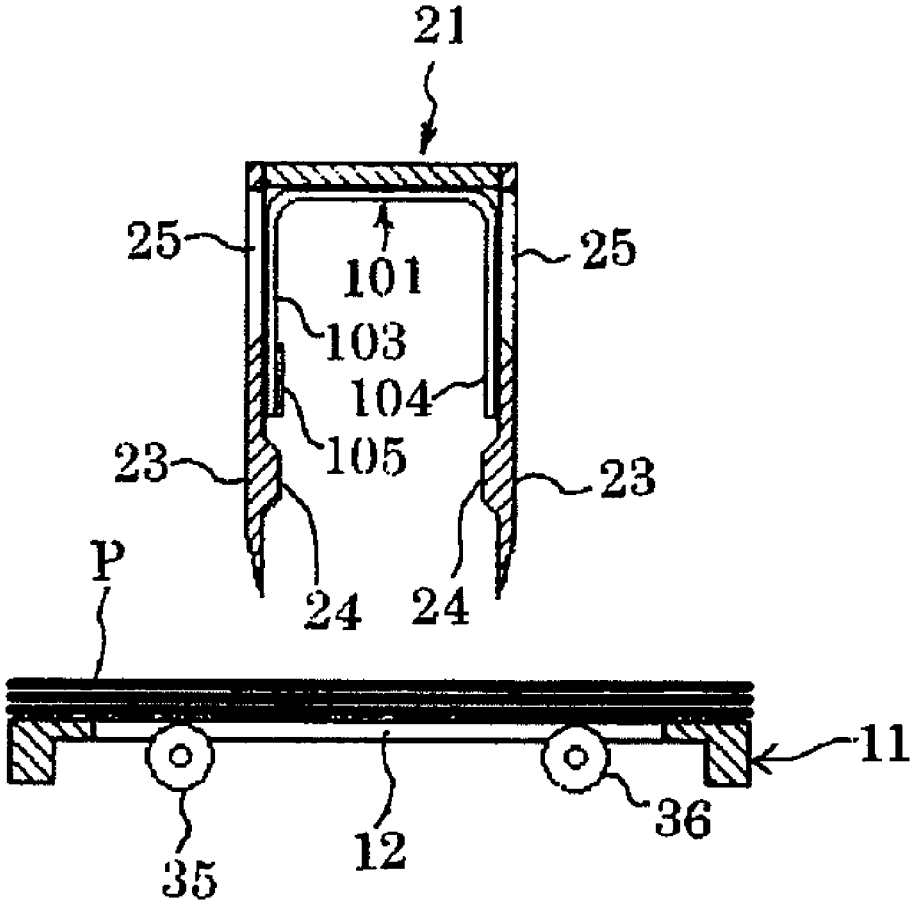
FIG. 5A to FIG. 5E are explanatory views showing a binding process according to the third embodiment.
Figure 5A:
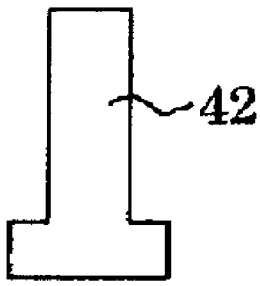
Figure 5B:
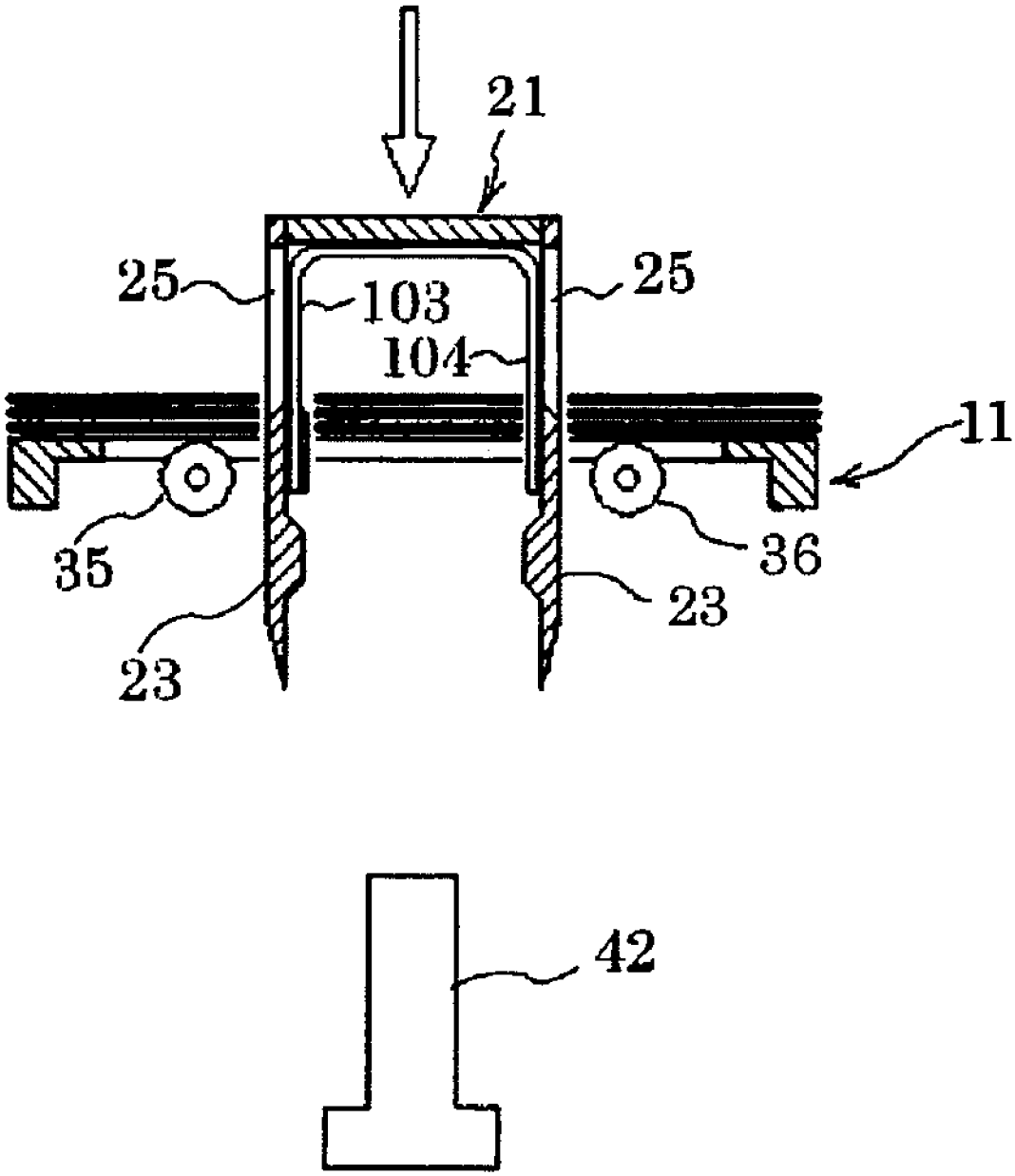
Figure 5C:
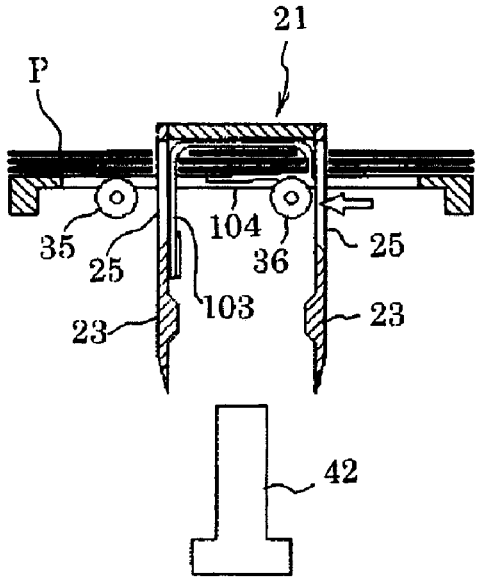

FIG. 5A shows an initial state, in which the interval between the pair of left and right rollers 35, 36 is opened so as not to prevent the cutter portion 21 from moving down. When the cutter blades 23 penetrate the sheets of paper P as shown in FIG. 5B, and the rectangular holes 25 of the cutter blades 23 come to the height where the rollers 35, 36 are positioned, first, the right roller 36 is moved in a direction in which the rollers 35, 36 come close to each other as shown in FIG. 5C. The right roller 36 is further moved to the inner side through the rectangular hole 25, thereby folding the right leg portion 104 of the paper staple 101. Since the right roller 36 as well as the left roller 35 can be moved deeply inside to a direction of a center of the cutter portion 21, the right leg portion 104 of the paper staple 101 is folded substantially by 90 degrees.

Figure 5D:
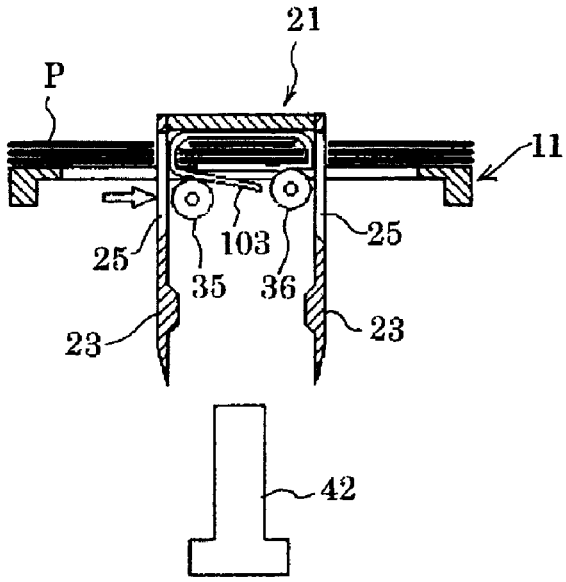

Subsequently, as shown in FIG. 5D, the left roller 35 is moved in a direction of being close to the right roller 36. The left roller 35 is further moved to the inner side through the rectangular hole 25 and folds the left leg portion 103 of the paper staple 101 substantially by 90 degrees in a similar way as the right roller 36, thereby overlapping the left leg portion 103 to the right leg portion 104.

Figure 5E:
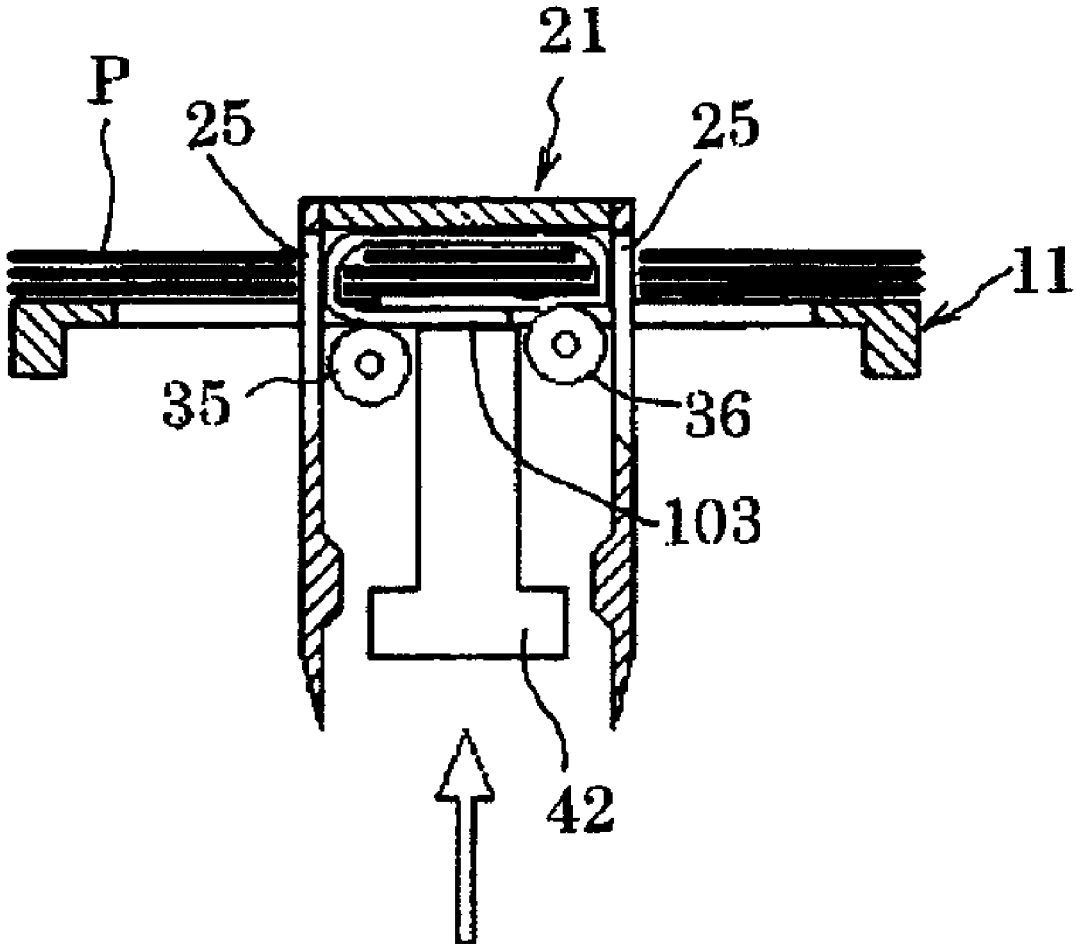

Then, as shown in FIG. 5E, the pressing piece 42 is moved up to press the left leg portion 103 and the right leg portion 104 that are overlapped, thereby pressing and bonding them.

After the press-bonding, the pressing piece 42 is moved down, the rollers 35, 36 are moved to retreating positions, and the cutter portion 21 is moved up, thereby releasing the sheets of paper P.

Embodiment 4

Figure 6:
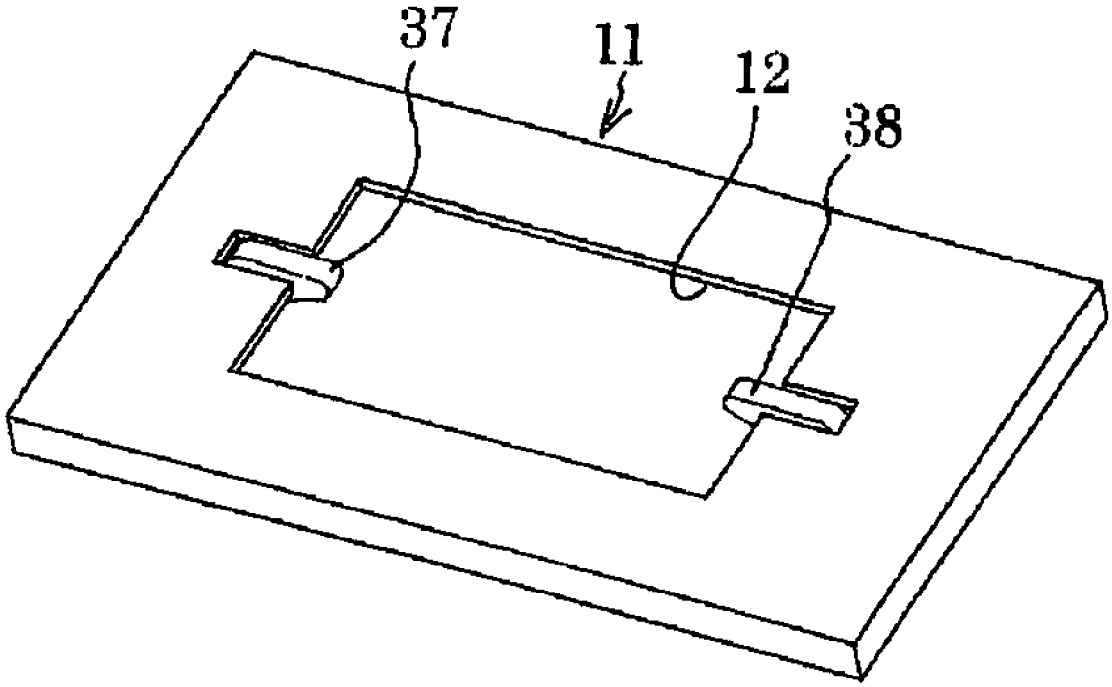
FIG. 6 is a perspective view showing an arrangement of a cam in a binding mechanism of a tape type binding apparatus according to a fourth embodiment.

In a fourth embodiment, cams 37, 38 are used instead of the rollers 35, 36 of the third embodiment. Similarly to the rollers 35, 36 of the third embodiment, upper ends of the cams 37, 38 are arranged substantially at the same height as the surface of the paper table 11 when the cams 37, 38 are in a closed state (most proximate state) as shown in FIG. 6. The pressing piece 42 is arranged below the paper table 11, the pressing piece being the clincher portion 41 of the first or the second embodiment, but without the left and right clinchers 43, 44.

Figure 7A:
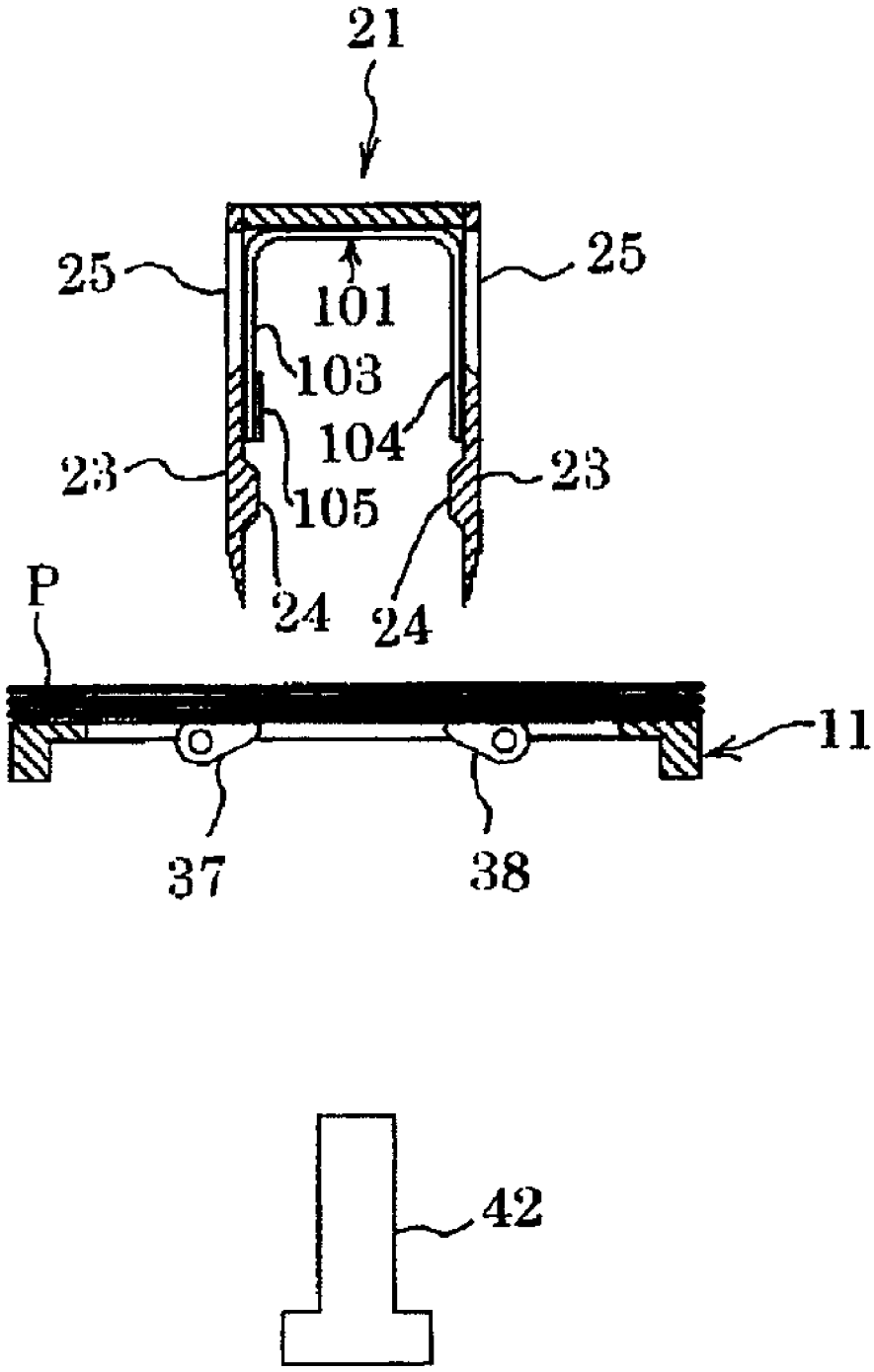
FIG. 7A to FIG. 7E are explanatory views showing a biding process according to the fourth embodiment.
Figure 7B:
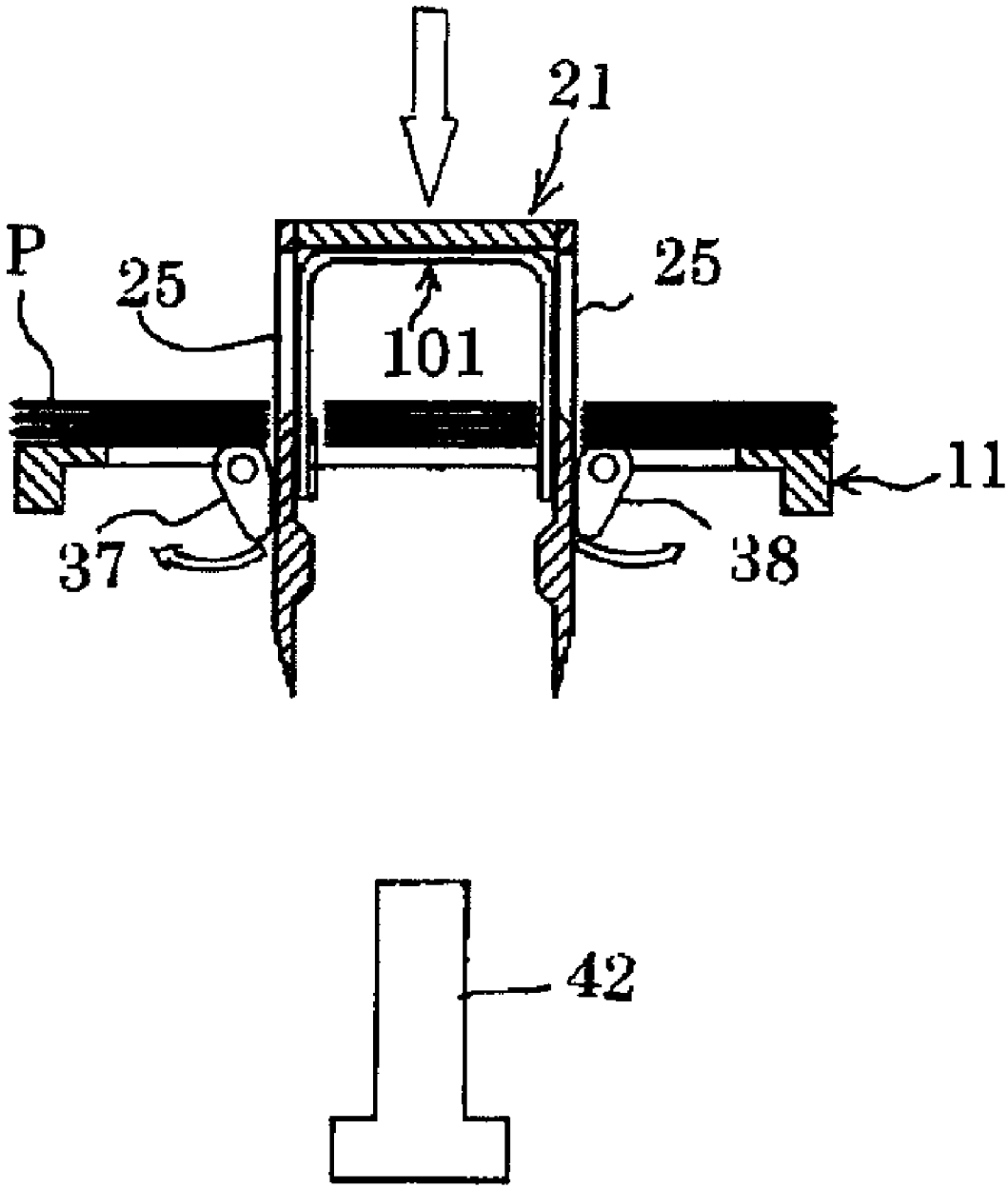

FIG. 7A to FIG. 7E show binding operation steps. When the cutter portion 21 is started to move down from an initial state shown in FIG. 7A, the pair of left and right cams 37, 38 are retreated from the path of the cutter blades 23 by being rotated to outer sides as shown in FIG. 7B.

Figure 7C:
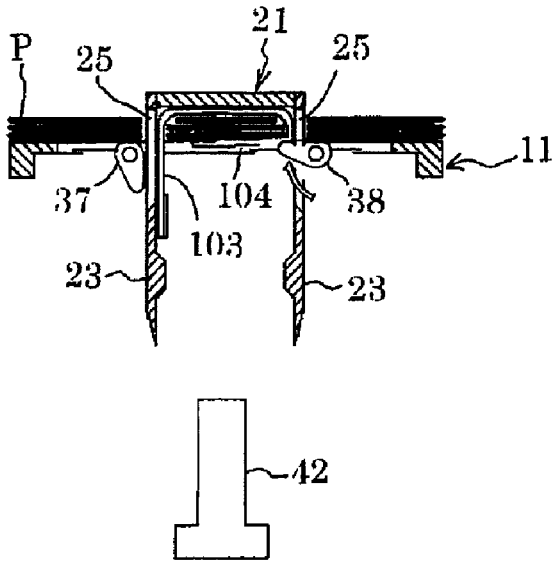

Then, as shown in FIG. 7C, when the cutter blades 23 penetrate the sheets of paper P and the rectangular holes 25 of the cutter blades 23 come to the height of the cams 37, 38, first, the right cam 38 is rotated in a direction in which the right cam 38 comes close to the left cam 37. The right cam 38 is further rotated to the inner side through the rectangular hole 25 and folds the right leg portion 104 of the paper staple 101 substantially by 90 degrees.

Figure 7D:
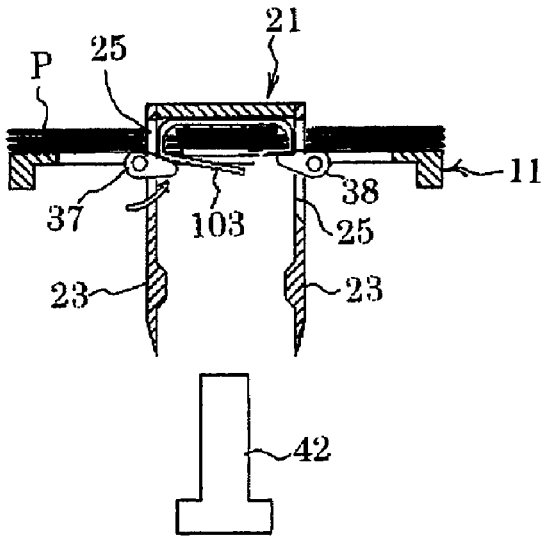

Subsequently, as shown in FIG. 7D, the left cam 37 is rotated in a direction of being close to the right cam 38. The left cam 37 is further rotated to the inner side through the rectangular hole 25 and folds the left leg portion 103 of the paper staple 101 substantially by 90 degrees in a similar way as the right cam 38, thereby overlapping the right leg portion 104.

Figure 7E:
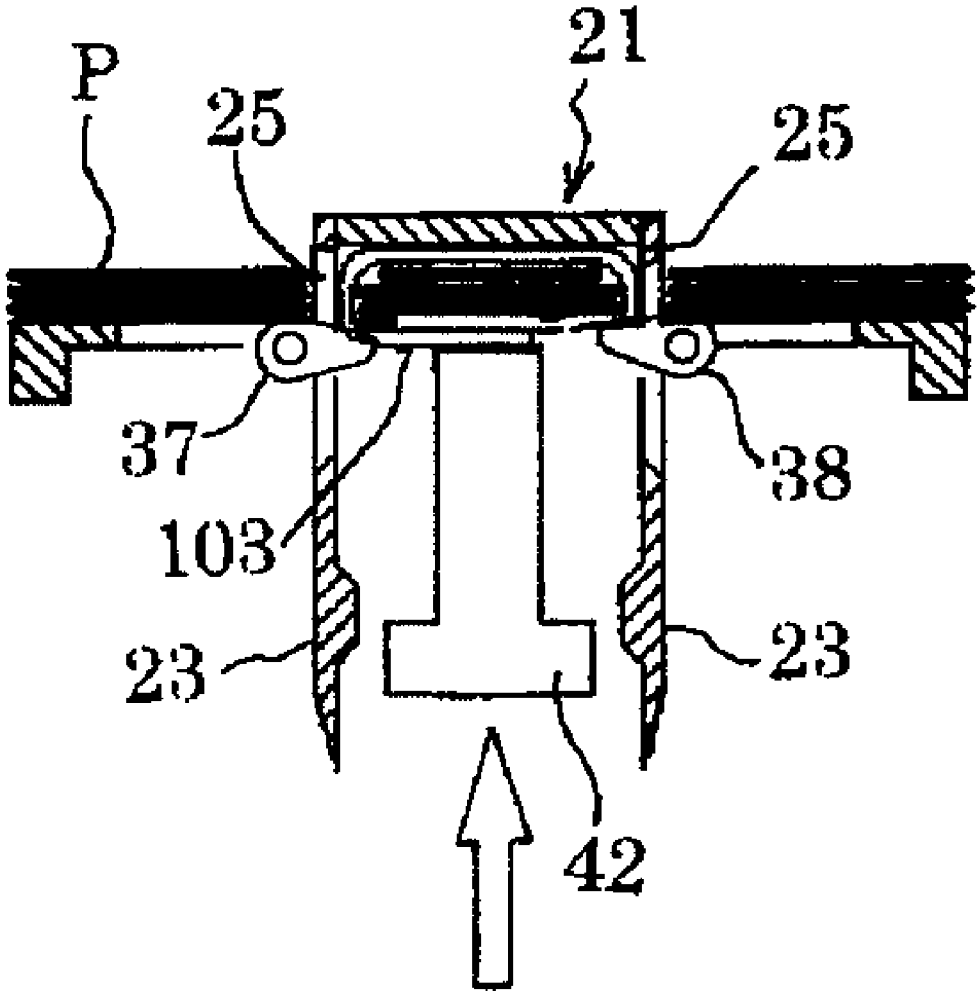

Further, as shown in FIG. 7E, the pressing piece 42 is moved up from the lower side to press the left leg portion 103 and the right leg portion 104 which are overlapped, thereby pressing and bonding them.

After the press-bonding, the pressing piece 42 is moved down, the left and right cams 37, 38 are rotated to retreating positions, and the cutter portion 21 is moved up, thereby releasing the sheets of paper P.

While description has been made in connection with the embodiments of the present invention, it will be obvious to those skilled in the art that various changes and modification may be made therein without departing from the present invention. It is aimed, therefore, to cover in the appended claims all such changes and modifications falling within the true spirit and scope of the present invention.

The subject patent application is based on a Japanese patent application No. 2005-365617 filed on Dec. 19, 2005, the entire content of which is incorporated herein by reference.

INDUSTRIAL APPLICABILITY

In a tape type binding apparatus according to the invention, the two leg portion of the U-shaped paper made staple are penetrated through the sheets, the two leg portions are folded to the inner sides, and the two leg portions are pressed from the lower side so as to be press-bonded. Therefore, different from the conventional ones, a sliding operation of the sheets is not necessary, thereby providing an excellent operability.

Further, operating steps of respective components are simple so that a frame structure similar to those of the staplers used heretofore can be easily applied. Accordingly, a compact, simple and convenient tape type binding apparatus can be provided regardless of driving means such as a motor-driven type or a manual type.

Furthermore, since the paper staple is partially provided with an adhesive agent layer at the inner face of one end thereof, the paper staple itself is not adhered to the sheets. Therefore, the paper staple can simply be removed when unbinding the stack of stapled sheets, thereby enhancing convenience.

The invention claimed is:

1. A tape type binding apparatus for binding a stack of sheets with a paper staple that is bent in a U-shape having an adhesive agent layer on an inner face thereof, the tape type binding apparatus comprising:

a cutter portion formed in a U-shape inside which the paper staple is held, the cutter portion including a pair of cutter blades, each formed with a rectangular hole;

a paper table formed with a drawing hole through which the pair of cutter blades can be inserted;

a pair of pressing members arranged on respective sides of the drawing hole, each pressing member being able to move toward a center of the drawing hole; and a pressing piece arranged below the center of the drawing hole, wherein the pair of cutter blades and leg portions of the paper staple penetrate the stack of sheets placed on the paper table by moving down the cutter portion which holds the paper staple thereinside, the pair of pressing members folds the leg portions of the paper staple to inner sides by moving toward the center of the drawing hole through the respective rectangular holes, and the pressing piece presses and bonds the folded leg portions by relatively moving up with respect to the paper table.

2. The tape type binding apparatus according to claim 1, wherein a width of each cutter blade is substantially equal to a width of the paper staple.

3. The tape type binding apparatus according to claim 1, further comprising a protrusion disposed on an inner face of each cutter blade, wherein the protrusion has a height that is higher than a thickness of the paper staple.

4. The tape type binding apparatus according to claim 1, further comprising a pair of clinchers, each arranged on respective sides of the pressing piece, wherein the pair of clinchers is slidable in a vertical direction and is biased upward, and the pair of clinchers folds the leg portions of the paper staple when the pressing piece relatively moves up with respect to the paper table, and thereafter, the pressing piece presses and bonds the folded leg portions.

5. The tape type binding apparatus according to claim 4, wherein heights of upper ends of respective clinchers are different.

6. The tape type binding apparatus according to claim 1, wherein the pair of pressing members is arranged below the paper table.

7. The tape type binding apparatus according to claim 1, wherein the pair of pressing members is arranged so as to be at a height that is substantially equal to a surface of the paper table.

8. A combination of a paper staple and a tape type binding apparatus, the paper staple comprising:

a paper tape that is bent in a U-shape; and an adhesive agent layer, wherein the paper tape includes a pair of leg portions, and the adhesive layer is provided at a lower portion of an inner face of only one of the leg portions, the tape type binding apparatus comprising:

a cutter portion formed in a U-shape inside which the paper staple is held, the cutter portion including a pair of cutter blades, each formed with a rectangular hole;

a paper table formed with a drawing hole through which the pair of cutter blades can be inserted;

a pair of pressing members arranged on respective sides of the drawing hole, each pressing member being able to move toward a center of the drawing hole; and a pressing piece arranged below the center of the drawing hole, wherein the pair of cutter blades and leg portions of the paper staple penetrate the stack of sheets placed on the paper table by moving down the cutter portion which holds the paper staple thereinside, the pair of pressing members folds the leg portions of the paper staple to inner sides by moving toward the center of the drawing hole through the respective rectangular holes, and the pressing piece presses and bonds the folded leg portions by relatively moving up with respect to the paper table.

* * * * *